US005086531A

United States Patent [19]

Carlos

[11] Patent Number: 5,086,531

[45] Date of Patent: Feb. 11, 1992

[54] DUST RUFFLE WITH SEPARABLE FASTENER

[76] Inventor: Mary L. Carlos, 4500 Roland Ave., Dallas, Tex. 75219

[21] Appl. No.: 702,308

[22] Filed: May 20, 1991

Related U.S. Application Data

[63] Continuation-in-part of Ser. No. 611,673, Nov. 13, 1990.

[51] Int. Cl.[5] ..... A47G 9/02

[52] U.S. Cl. ..... 5/493

[58] Field of Search ..... 5/493, 497, 502, 482

[56] References Cited

U.S. PATENT DOCUMENTS

| | | | |
|---|---|---|---|
| 2,619,658 | 12/1952 | Weinberg | 5/493 |
| 3,144,666 | 8/1964 | Mazera et al. | 5/493 |
| 3,999,233 | 12/1976 | Morris | 5/493 |
| 4,141,097 | 2/1979 | Levinsohn et al. | 5/493 |
| 4,386,439 | 6/1983 | Rollograndi et al. | 5/493 |
| 4,587,683 | 5/1986 | Gardiner | 5/493 |
| 4,734,947 | 4/1988 | Vatale | 5/493 |
| 4,796,317 | 1/1989 | Kallman et al. | 5/493 |
| 4,897,891 | 2/1990 | Kallman et al. | 5/493 |

*Primary Examiner*—Alexander Grosz

*Attorney, Agent, or Firm*—Michael A. O'Neil

[57] ABSTRACT

A dust ruffle having a section of fabric with dimensions slightly larger than a box spring, a first section of decorative fabric which descends vertically towards the floor and is attached to a second U-shaped section of decorative fabric. The U-shaped strip of decorative fabric is superimposed on, and attached via fasteners, to the support section of fabric along a line spaced inwardly towards the center of the box spring. The dust ruffle may be removed from the support fabric so that the support fabric may be cleaned. An elastic band is attached to the peripheral edges of the support fabric to enable the fabric to substantially conform to the shape of the box spring.

10 Claims, 3 Drawing Sheets

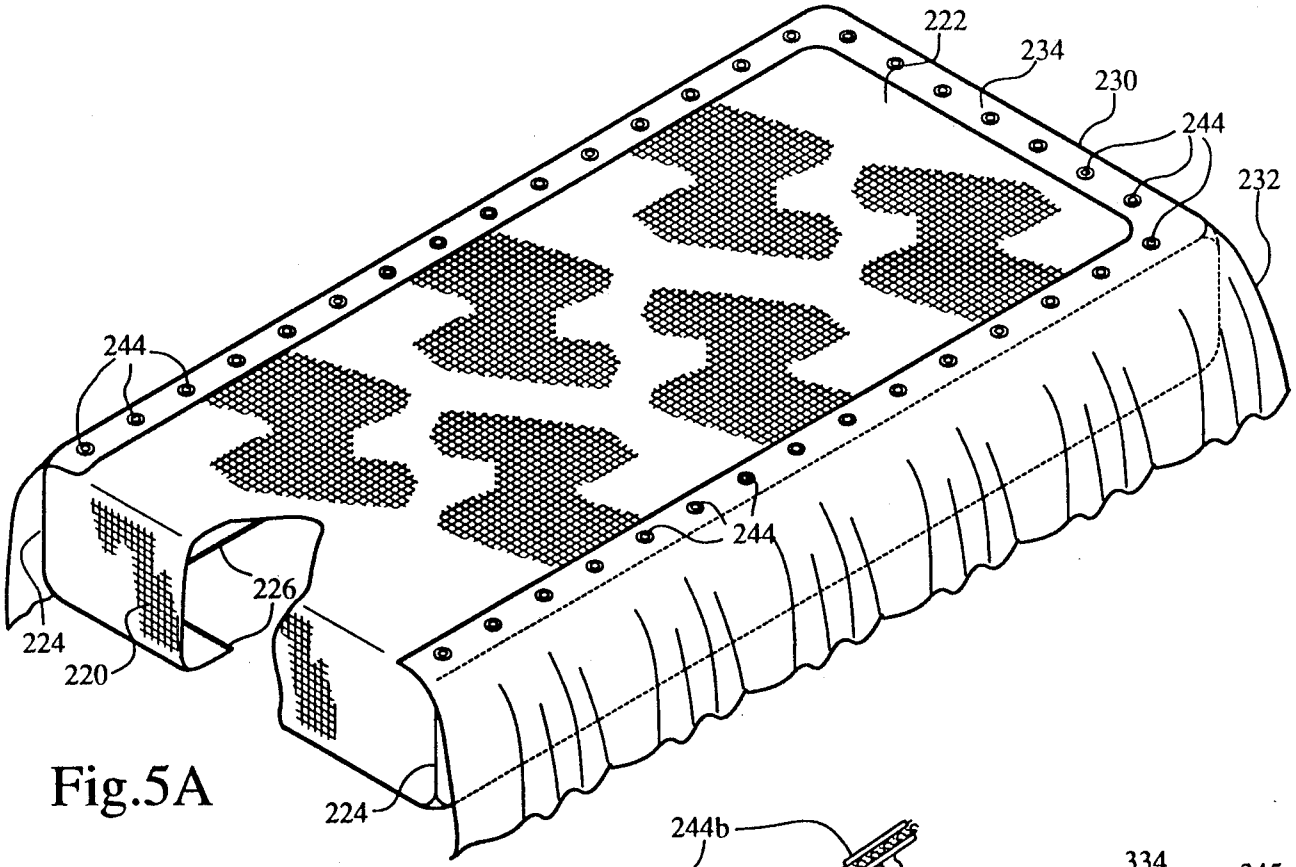
Fig.5A
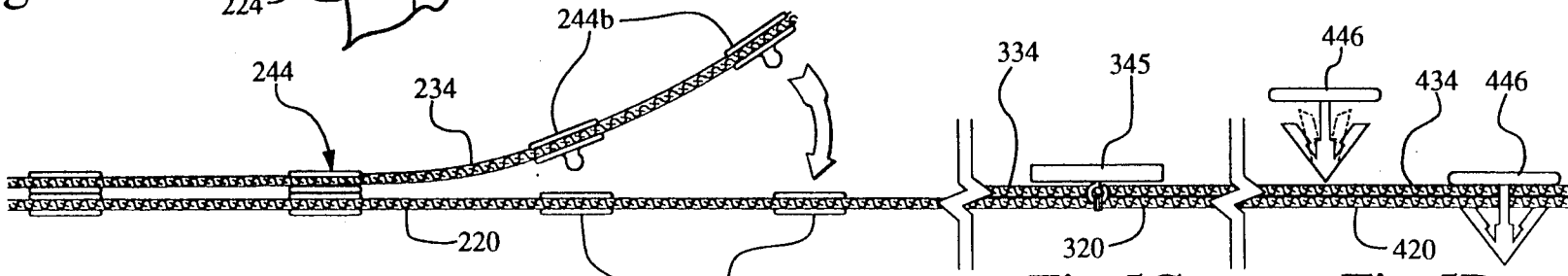
Fig.5B
Fig.5C
Fig.5D

DUST RUFFLE WITH SEPARABLE FASTENER

RELATED APPLICATIONS

This application is a continuation-in-part of copending U.S. application Ser. No. 611,673, filed Nov. 13, 1990

TECHNICAL FIELD

This invention relates generally to bedding, and more particularly to the positioning of a dust ruffle on a bed.

BACKGROUND OF THE INVENTION

Dust ruffles have been used over the years to decrease dust collection under beds and to provide an aesthetically pleasing appearance to the bedroom. Typically, dust ruffles comprise a piece of decorative fabric attached on three sides to a piece of less costly, flat, sheet-like fabric, which is sandwiched between the box spring and mattress of a bed. The major problem with this design is that the dust ruffle has no structure to secure its position on the bed. In response to the natural movements of sleepers during the night, the unsecured dust ruffle has a tendency to shift from side to side or from the head towards the foot of the bed. Left unchecked, the dust ruffle is no longer evenly distributed on the bed, creating an unsightly appearance.

Initially, dust ruffle users relied on the weight of the mattress to secure the dust ruffle in place, accompanied by regular removal of the mattress from the bed in order to reorient the dust ruffle to its proper position. When this proved unsatisfactory, many dust ruffle users resorted to employing safety pins to secure the dust ruffle to the box spring. Although this approach solved the problem of the dust ruffle's tendency to shift, it had an unsatisfactory side-effect. The weight and the unstructured design of the dust ruffle, in combination with the movements of sleepers, caused the safety pins to strain against and ultimately tear the dust ruffle at it points of attachment. The dust ruffle user had to regularly repair the tears in the fabric or replace the dust ruffle.

In an effort to eliminate the foregoing combination of undesirable characteristics, dust ruffles have been constructed with an elastic means conforming the dust ruffle to the shape of a bed. Although such fitted products have generally proven effective in securing the dust ruffle to the bed, prior designs have not been acceptable for prolonged use. For example, the product described in U.S. Pat. No 4,734,947, utilizes attachment of the dust ruffle to a fitted mattress pad, which overlies the mattress of a bed. Using an elastic means solves the shifting dust ruffle problem, however, it creates at least two additional problems. First, any soiling of the bed sheets and underlying mattress pad which requires removal of same for cleaning, also necessitates cleaning of the dust ruffle. Since most dust ruffles are constructed of decorative fabric which must be drycleaned, the dust ruffle user is forced to dryclean the mattress pad solely due to the attached dust ruffle. This is a costly and unnecessary expense Repeated drycleaning, with its associated chemicals, also decreases the life of the dust ruffle. Additionally, during the period of time that the mattress pad and attached dust ruffle are being cleaned, the dust ruffle user needs a replacement dust ruffle, or is forced to leave the bed with a less-than-finished appearance. Both choices are undesirable.

Secondly, stress is placed on the peripheral edges of the mattress pad, along which the dust ruffle is attached. Over a prolonged period of time, the weight of the dust ruffle may cause the elastic means to lose its elasticity. Additionally, the weight of the dust ruffle tends to pull the edges of the mattress pad from underneath the mattress. Furthermore, weight of the dust ruffle may also cause pulling and tearing of the fabric along the line of attachment, similar to the tears produced by the use of safety pins.

SUMMARY OF THE INVENTION

The present invention comprises a highly practical dust ruffle which overcomes the foregoing disadvantages associated with the prior art. In a first embodiment, a fitted support member comprises a substantially rectangular section of woven fabric to which a dust ruffle is joined. The support member has mitered corners, and an elastic member is employed to substantially conform the support member to the shape of a box spring. A U-shaped strip of the same decorative fabric used in the construction of the dust ruffle is superimposed on and attached to the support member. The U-shaped strip provides a uniform appearance if the mattress is moved slightly out of position; aids in the proper orientation of the dust ruffle so that the ruffle descends from the edges of the box spring; and provides additional support to the support member against strain from the weight of the dust ruffle fabric.

The resulting construction ensures that the dust ruffle will remain in proper position on the box spring, while permitting the dust ruffle user to change the bed sheets or flip the mattress.

In the second through fifth embodiments of the invention, the U-shaped strip of decorative fabric is superimposed on and attached to the support member via fasteners. Because the U-shaped strip is not permanently secured to the support member, the dust ruffle may be removed prior to cleaning the support member, thereby prolonging the life of the dust ruffle.

DESCRIPTION OF THE DRAWINGS

For a more complete understanding of the present invention and the advantages thereof, reference is now made to the following Detailed Description taken in conjunction with the accompanying Drawings in which:

FIG. 5A is a view of a third embodiment of the invention wherein snaps attach the dust ruffle to the support member;

FIG. 5B is an enlarged view of the snap assembly illustrating the attachment of the dust ruffle to the support member;

FIG. 5C is an enlarged view of a fourth embodiment of the invention wherein the dust ruffle attaches to the support member via a series of buttons inserted in button holes; and FIG. 5D is an enlarged view of a fifth embodiment of the invention wherein the dust ruffle attaches to the support member via a series of button-topped shanks.

DETAILED DESCRIPTION

Figure 1:
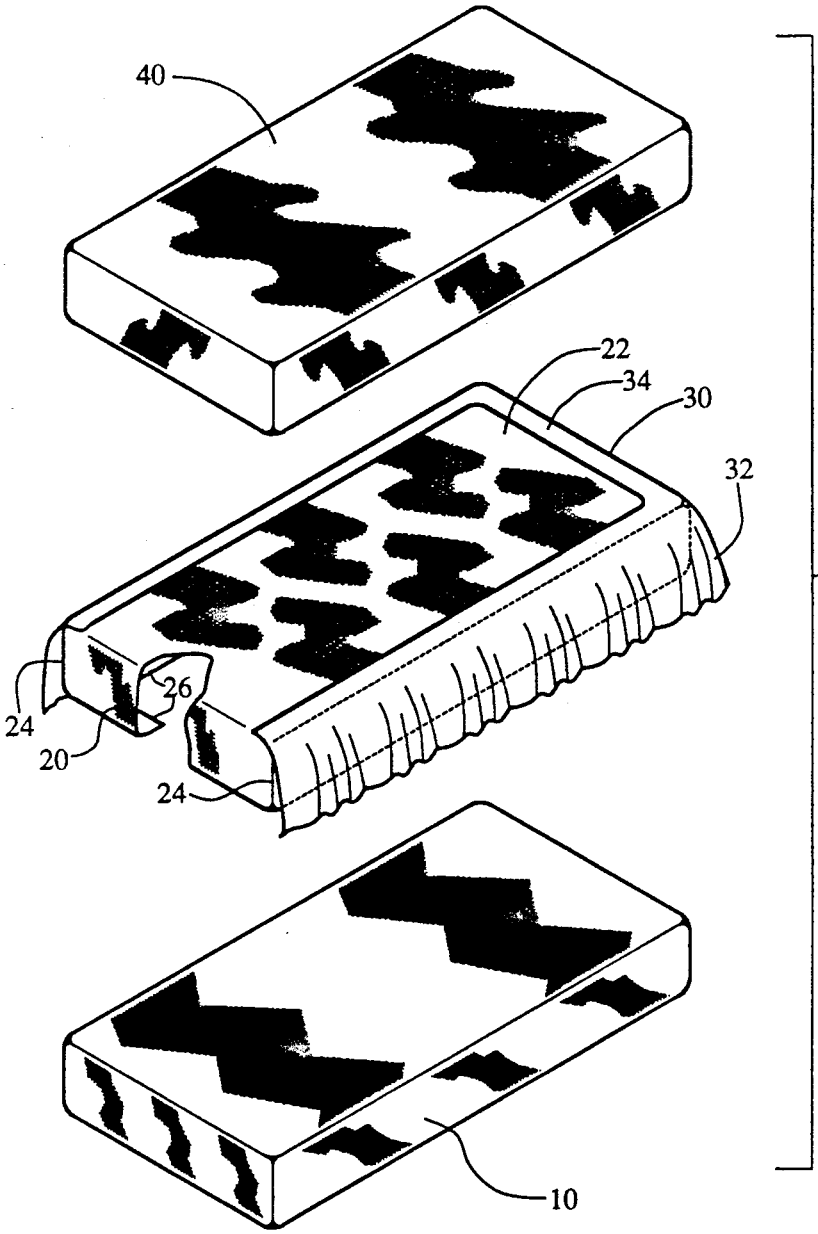
FIG. 1 is an exploded view of a bed with dust ruffle, showing the features of the first embodiment of the invention and the spatial relationship between the dust ruffle, box spring and mattress.

Referring now to the Drawings wherein like reference characters designate like or similar parts throughout the several views, FIG. 1 is an exploded view of an assembled bed, showing the features of the invention. FIG. 1 shows a box spring 10 which is covered by a support member 20 with attached dust ruffle 30. A mattress 40 overlies the box spring 10 and the support member 20. The box spring 10 may rest on top of a conventional bed frame 12.

In a preferred embodiment, the support member 20 is constructed of a section of woven fabric 22 which has dimensions slightly larger than the shape of the box spring 10, and which is of substantially rectangular shape. The woven fabric 22 may be muslin or any other low-cost fabric. The support member 20 has mitered corners 24 and an elastic band 26 which substantially conforms the support member 20 to the shape of the box spring 10. The elastic band 26 is attached to the peripheral edges of the support member 20, such that when the support member 20 is placed on the box spring 10, the elastic band 26 is positioned on the underside of the box spring 10.

The dust ruffle 30 consists of several sections of decorative fabric which are attached to the support member 20. The main section of dust ruffle 32 is secured to the support member 20 along the perimeter of the horizontal surface of the box spring 10, and descends vertically to a point touching the floor. This section of fabric may be gathered, pleated, etc. pursuant to the dust ruffle user's wishes.

A U-shaped strip of decorative fabric 34 is superimposed on and attached to the support member 20 along the perimeter of the horizontal surface of the box spring 10 and along a line inward towards the center of the bed. In a preferred embodiment, this U-shaped strip of decorative fabric 34 is approximately one to two feet in width.

Figure 2:
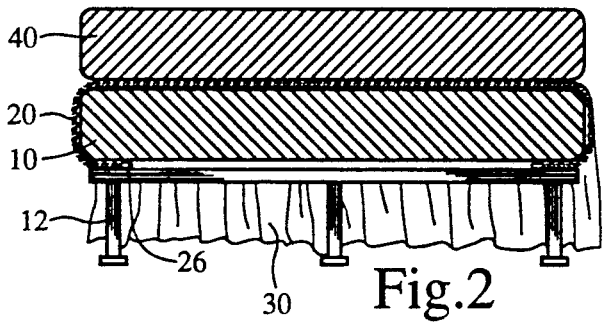
FIG. 2 is a longitudinal cross-sectional view of an assembled bed showing attachment of the dust ruffle to the support member according to the first embodiment of the invention.

Referring to FIG. 2, the box spring 10 is covered by the support member 20 with attached dust ruffle 30. The box spring 10 rests on top of the bed frame 12. The mattress 40 overlies the box spring 10 and the support member 20. The support member 20 consists of the section of woven fabric 22 which has an elastic band 26. The dust ruffle 30 is attached to the support member 20 along the perimeter of the horizontal surface of the box spring 10. The main part of the dust ruffle 32 descends vertically to a point touching the floor.

Figure 3:
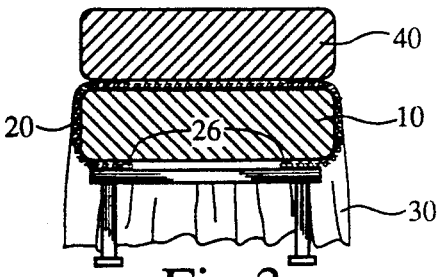
FIG. 3 is a transverse cross-sectional view of an assembled bed, showing attachment of the dust ruffle to the support member on three sides only according to the first embodiment of the invention.

Turning to FIG. 3, the dust ruffle 30 is attached to the support member 20 on three sides only. The mattress 40 overlies the box spring 10 and the support member 20 with attached dust ruffle 30.

FIGS. 4A through 5D illustrate alternate embodiments of the present invention. Certain of the component parts of the alternate embodiments of the invention are the same or similar to component parts of the first embodiment of the invention. Such same or similar component parts are designated in FIGS. 4A through 5D with the same reference numerals used in connection with the first embodiment of the invention, but are differentiated by a series of numbers from 100 through 400.

Figure 4A:
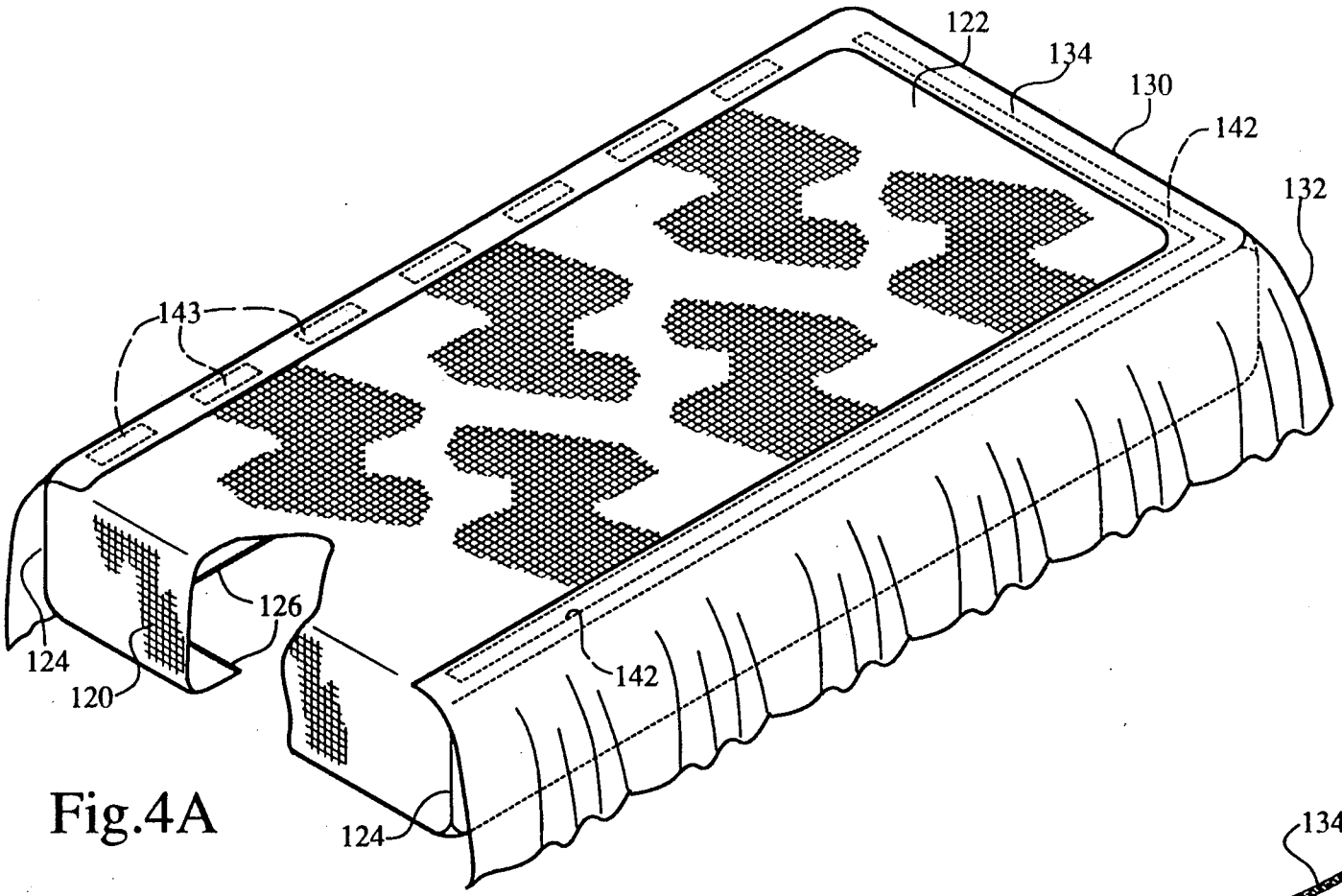
FIG. 4A is a view of a second embodiment of the invention wherein hook and loop fasteners attach the dust ruffle to the support member.

Referring to FIG. 4A, there is shown a second embodiment of the invention wherein a dust ruffle 130 is attached to the support member 120 via strips of hook and loop fasteners 142 or 143. The first section of decorative fabric 132 of the dust ruffle 130 is permanently secured to the second U-shaped section of decorative fabric 134. The U-shaped fabric 134 is attached to the support member 120 with strips of hook and loop fasteners 142 or 143.

The hook and loop fasteners 142 and 143 are of a type well known in the art. In a preferred embodiment, hook and loop fasteners similar to the product sold under the trademark Velcro ® are used to attach the dust ruffle to the support member. Long 142 or short 143 pieces of hook and loop fasteners may be used, depending upon the preference of the dust ruffle manufacturer.

Figure 4B:
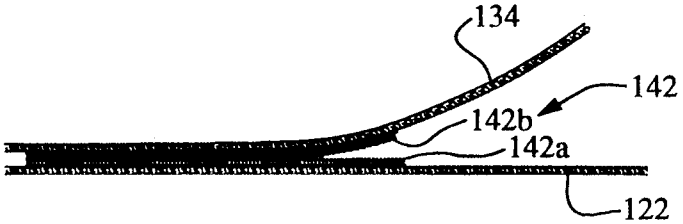
FIG. 4B is an enlarged view of the hook and loop fastener assembly illustrating the attachment of the dust ruffle to the support member.

FIG. 4B illustrates the process of attaching the dust ruffle to the support member using the hook and loop fastener assembly 142. One component **142*a* of the hook and loop fastener assembly 142 is secured to the horizontal top surface of the support member 120 along a line spaced inwardly towards the center of the box spring 110. The other component 142*b* of the hook and loop fastener assembly 142 is attached to the undersurface of the U-shaped section of fabric 134. When the two components 142*a* and 142*b* are connected, the dust ruffle will be secured to the support member 120. When contact between the components 142*a* and 142*b*** is broken, the dust ruffle may be removed from the bed.

Turning now to FIG. 5A, there is shown a third embodiment of the invention. The first section 232 of the dust ruffle 230 is permanently secured to the second U-shaped section of fabric 234, which is attached to the support member 220 via a series of snaps 244. The snaps 244 are of a type well known in the art. In a preferred embodiment, a plurality of snaps 244 are used to ensure that the dust ruffle 230 remains attached to the support member 220. The snaps 244 are evenly spaced around the three sides of the U-shaped section of fabric 234 for optimum support.

FIG. 5B illustrates the procedure for attaching the dust ruffle to the support member 220 using the snap assembly 244. One component **244*a* of the snap assembly 244 is attached to the horizontal top surface of the support member 220 along a line spaced inwardly towards the center of the box spring 210. The other component 244*b* of the snap assembly 244 is secured to the underside of the U-shaped section of decorative fabric 234. When the dust ruffle user connects components 244*a* and 244*b*, the dust ruffle is secured to the support member 220. When the dust ruffle user disconnects components 244*a* and 244*b* of the snap assembly 244, the dust ruffle detaches from the support member 220, and the support member 220** is ready for cleaning.

Referring now to FIG. 5C, there is shown a fourth embodiment of the invention wherein a two-component button assembly attaches the dust ruffle to the support member 320. The support member 320 has a series of button holes in the horizontal surface (not shown). Secured via thread to the underside of the U-shaped section of fabric 334 are a series of buttons 345. To attach the U-shaped section of fabric 334 to the support member 320, the dust ruffle user inserts the button 345 into the corresponding button hole. To remove the dust ruffle 334, the user reverses the process.

FIG. 5D illustrates a fifth embodiment of the invention utilizing a one-component button assembly 446 to attach the dust ruffle to the support member 420. The U-shaped fabric 434 and the support member 420 are aligned with each other. A flat button attached to a sharp shank is inserted into the U-shaped section of fabric 434 and the support member 420.

Although preferred embodiments of the invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A unitary dust ruffle adapted to be positioned on a box spring which supports a mattress comprising:

a section of support fabric with dimensions slightly larger than the box spring, said support fabric covering the horizontal top surface and vertical sides of the box spring and having peripheral edges extending beneath the bottom of the box spring;

elastic means attached to the peripheral edges of the section of support fabric to enable the section of support fabric to substantially conform to the shape of the box spring;

a first section of decorative fabric secured to a second section of decorative fabric, and descending vertically towards the floor above which the box spring is supported;

the second section of decorative fabric being comprised of a U-shaped strip superimposed on and attached to the first section of fabric along a line spaced inwardly towards the center of the box spring, this line corresponding to the width of the strip; and releasable fastening means secured to the second section of decorative fabric and the section of support fabric for releasably connecting same.

2. A dust ruffle according to claim 1 wherein the section of support fabric is of substantially rectangular shape.

3. A dust ruffle according to claim 1 wherein the section of support fabric includes mitered corners.

4. A dust ruffle according to claim 1 wherein the dust ruffle extends vertically from only three sides of the box spring.

5. A dust ruffle according to claim 1 wherein the width of the U-shaped strip of decorative fabric is uniform.

6. A dust ruffle according to claim 1 wherein the U-shaped strip of decorative fabric is approximately one to two feet in width.

7. A unitary dust ruffle adapted to be positioned on a box spring which supports a mattress comprising:

a section of support fabric with dimensions slightly larger than the box spring, said support fabric covering the horizontal top surface and vertical sides of the box spring and having peripheral edges extending beneath the bottom of the box spring;

elastic means attached to the peripheral edges of the section of support fabric to enable the section of support fabric to substantially conform to the shape of the box spring;

a first section of decorative fabric secured to a second section of decorative fabric, and descending vertically towards the floor above which the box spring is supported;

the second section of decorative fabric being comprised of a U-shaped strip superimposed on and attached to the first section of fabric along a line spaced inwardly towards the center of the box spring, this line corresponding to the width of the strip; and a hook and loop fastener assembly secured to the second section of decorative fabric and the section of support fabric for connecting same.

8. A unitary dust ruffle adapted to be positioned on a box spring which supports a mattress comprising:

a section of support fabric with dimensions slightly larger than the box spring, said support fabric covering the horizontal top surface and vertical sides of the box spring and having peripheral edges extending beneath the bottom of the box spring;

elastic means attached to the peripheral edges of the section of support fabric to enable the section of support fabric to substantially conform to the shape of the box spring;

a first section of decorative fabric secured to a second section of decorative fabric, and descending vertically towards the floor above which the box spring is supported;

the second section of decorative fabric being comprised of a U-shaped strip superimposed on and attached to the first section of fabric along a line spaced inwardly towards the center of the box spring, this line corresponding to the width of the strip; and two-component snap assembly secured to the second section of decorative fabric and the section of support fabric for connecting same.

9. A unitary dust ruffle adapted to be positioned on a box spring which supports a mattress comprising:

a section of support fabric with dimensions slightly larger than the box spring, said support fabric covering the horizontal top surface and vertical sides of the box spring and having peripheral edges extending beneath the bottom of the box spring;

elastic means attached to the peripheral edges of the section of support fabric to enable the section of support fabric to substantially conform to the shape of the box spring;

a first section of decorative fabric secured to a second section of decorative fabric, and descending vertically towards the floor above which the box spring is supported;

the second section of decorative fabric being comprised of a U-shaped strip superimposed on and attached to the first section of fabric along a line spaced inwardly towards the center of the box spring, this line corresponding to the width of the strip; and a two-component button assembly secured to the second section of decorative fabric and the section of support fabric for connecting same.

10. A unitary dust ruffle adapted to be positioned on a box spring which supports a mattress comprising:

a section of support fabric with dimensions slightly larger than the box spring, said support fabric covering the horizontal top surface and vertical sides of the box spring and having peripheral edges extending beneath the bottom of the box spring;

elastic means attached to the peripheral edges of the section of support fabric to enable the section of support fabric to substantially conform to the shape of the box spring;

a first section of decorative fabric secured to a second section of decorative fabric, and descending vertically towards the floor above which the box spring is supported;

the second section of decorative fabric being comprised of a U-shaped strip superimposed on and attached to the first section of fabric along a line spaced inwardly towards the center of the box spring, this line corresponding to the width of the strip; and a one-component button assembly comprising a button attached to a sharp shank and secured to the second section of decorative fabric and the section of support fabric for connecting same.

* * * * *